US005882477A

United States Patent [19]

Laakso et al.

[11] Patent Number: 5,882,477

[45] Date of Patent: Mar. 16, 1999

[54] CONTINUOUS DIGESTER WITH A LOW TEMPERATURE GAS-PHASE

[75] Inventors: Richard Laakso, Queensbury; C. Bertil Stromberg, Glen Falls, both of N.Y.

[73] Assignee: Ahlstrom Machinery, Inc., Glen Falls, N.Y.

[21] Appl. No.: 797,327

[22] Filed: Feb. 10, 1997

[51] Int. Cl.[6] ..... D21C 7/00; D21C 3/26

[52] U.S. Cl. ..... 162/63; 162/66; 162/17; 162/19; 162/41; 162/47; 162/52

[58] Field of Search ..... 162/17, 19, 29, 162/34, 37, 38, 39, 41, 42, 46, 43, 52, 63, 64, 65, 68, 246, 250, 251, 237

[56] References Cited

U.S. PATENT DOCUMENTS

| | | | |
|---|---|---|---|
| 3,380,883 | 4/1968 | Richter et al. . | |
| 3,429,773 | 2/1969 | Richter . | |
| 3,532,594 | 10/1970 | Richter . | |
| 3,578,554 | 5/1971 | Richter . | |
| 3,802,956 | 4/1974 | Backlund . | |
| 4,668,340 | 5/1987 | Sherman | 162/16 |
| 5,053,108 | 10/1991 | Richter | 162/237 |
| 5,236,553 | 8/1993 | Richter | 162/237 |
| 5,413,677 | 5/1995 | Collins | 162/42 |
| 5,536,366 | 7/1996 | Marcoccia et al. | 162/43 |

OTHER PUBLICATIONS

Annergren et al, "Neutral Sulfite Semichemical Pulping with Diffusion Washing in a Kamyr Digester", Tappi, The Journal of the Technical Association of the Pulp and Paper Industry, vol. 51, No. 5, May 1968.

"The History of Kamyr Continuous Cooking" by Johan Richter, 1981, pp. 48 through 51.

"Continuous Pulping Processes" by Sven Rydholm, Tappi Stap Series, 1970, lecture 9, pp. 121–157.

"Continuous Digesters" by Brian Greenwood, Kamyr, Inc., Apr., 1991, CPPA Tech '91 Kraft Pulping Course, pp. 2.1–2.14.

*Primary Examiner*—Stanley S. Silverman
*Assistant Examiner*—Jose A. Fortuna
*Attorney, Agent, or Firm*—Nixon & Vanderhye P.C.

[57] ABSTRACT

A cellulose pulp continuous digester (e.g. for producing kraft pulp) is operated so that it has the advantages of a hydraulic digester yet has a gas-filled zone over the liquid level. A slurry of chips and cooking liquor is introduced into the top of the digester vessel through an inverted top separator. A liquid level is established below the inverted top separator, and a chips level is established below the inverted top separator (above or below the liquid level). A gas-filled zone above the liquid level includes compressed gas, and is at a temperature of less than 160 (preferably less than 120)°C. and at a pressure of between 50–200 (preferably 80–150) psig. The chips are heated by recirculating and heating liquid using a recirculation loop below the chips level, and a countercurrent flow zone is preferably provided.

20 Claims, 3 Drawing Sheets

CONTINUOUS DIGESTER WITH A LOW TEMPERATURE GAS-PHASE

BACKGROUND AND SUMMARY OF THE INVENTION

In the art of continuous digesting of comminuted cellulosic fibrous material to produce cellulose pulp, from which paper products are made, there are essentially two types of digesters: the hydraulic digester and the dual-phase or vapor-phase digester. A hydraulic digester is a pressure-resistant vessel which is completely filled with comminuted cellulosic fibrous material and liquid; any introduction or removal of liquid from the vessel affects the typically super-atmospheric pressure within the vessel. A vapor-phase digester is not completely filled with liquid but includes a section at the top containing super-atmospheric steam. Since this gas zone is compressible compared to the liquid zone below it, the pressure within a vapor-phase digester is typically determined by the pressure of the gas present at the top of the digester. Prior art vapor-phase digesters are illustrated in U.S. Pat. Nos. 3,380,883; 3,429,773; 3,532,594; 3,578,554; and 3,802,956.

The reaction of pulping chemicals with comminuted cellulosic fibrous material to produce a chemical pulp requires temperatures ranging between 140°–180° C. Since at atmospheric conditions the aqueous chemicals used to treat the material would boil at such temperatures, commercial chemical pulping is typically performed in a pressure-resistant vessel under pressures of at least about 5 bars gauge (i.e., at least approximately 70 psi gauge).

One principal distinction between the method of operation of these two types of digesters is the way the contents of the digesters are heated to the desired 140°–180° C. In the hydraulic digester, the slurry of comminuted cellulosic fibrous material, typically wood chips, and cooking liquor is typically heated by means of heated liquid circulations, i.e. one or more recirculation loops. Liquid is typically removed from the digester, for example, by using an annular screen assembly and pump, heated with steam by means of an indirect heat exchanger, and re-introduced to the material in the vessel using a centrally located pipe. In the vapor-phase digester, the chips are typically heated by exposing the chips to steam. This steam heating is typically performed as the chips are introduced to the steam-filled zone at the top of the digester.

In addition to the method of heating, the operation of the hydraulic and vapor-phase digester also differs in the methods used to monitor and control the level of chips and liquid in the vessel. Since the hydraulic digester is completely filled with liquid, only the level of chips need be monitored. The level of chips in a hydraulic digester is typically monitored using mechanical paddles, the deflection of which is detected by electronic strain gauges or similar devices. Typically two or more, preferably three or more, of these electro-mechanical devices are located on the inner surface of the hydraulic digester. The presence or absence of chips at the level of the paddle is determined by the degree of deflection or agitation of each paddle by the chips. The agitation of each paddle is detected by the strain gages and an approximate level of chips in the hydraulic digester, expressed as a percent, is determined via a mathematical algorithm. The operator can vary the chip level by varying the input of chips or output of pulp from the hydraulic digester.

In a vapor-phase digester, two levels must be monitored and controlled: the level of chips, similar to the hydraulic digester, and the level of the liquid. However, unlike the hydraulic digester, in a vapor-phase digester the chips are not submerged in liquid at the top of the digester. By the nature of the vapor-phase digester, which requires the direct exposure of chips to steam for heating, the chip level in a vapor-phase digester is above the level of the liquid. This unsubmerged (exposed) chip level is typically detected by a gamma-radiation emitter/detector device mounted on the side of the digester vessel. The liquid level in a vapor phase digester is detected by conventional liquid pressure detecting devices, for example a "dp cell".

Furthermore, chips are introduced to the two types of digesters using different mechanical devices. Wood chips, or other comminuted cellulosic fibrous material, are typically fed to the inlet of a continuous digester using a separate feed system. The feed system typically includes equipment for de-aerating, heating, pressurizing, and introducing cooking liquor to the chips before transferring a slurry of chips and liquor to the digester. In the case of the hydraulic digester, this slurry of chips and liquor is introduced in a downward-directed screw-type conveyor, known in the art as a "top separator". In the vapor-phase digester, since the slurry is introduced to a gas space, the slurry of chips and liquor is transferred upward in a screw-type conveyor in which the chips and liquor overflow the top of the conveyor and fall freely in the steam-filled atmosphere. This upward flow and overflow of chips and liquid is ideally suited to the vapor-phase digester because it prevents the escape of gas as the slurry is introduced to the digester while providing a weir-type reservoir for removing excess liquid. This device is known in the art as an "inverted top separator". Both devices remove excess liquid from the slurry so that it can be returned to the feed system (e.g. conventional high pressure feeder) as a source of slurrying liquid. The functions of these devices are similar, but they have distinct applications to their respective type of digester.

Conventionally, the construction and operation of hydraulic and vapor-phase digesters are also distinctly different. No one of ordinary skill in the art would consider operating one type of digester in the fashion of the other, at least without significant modification to the respective digester. For example, the vapor-phase digester does not typically have the same number of annular screens or liquor circulations required for heating in a hydraulic digester. Also, the hydraulic digester typically does not have a device for detecting the level of chips above the liquid level that a vapor-phase digester requires. Furthermore, the two types of top separators are different in construction and mode of operation.

There are several disadvantages to the vapor-phase digester in comparison to the hydraulic digester. For example, exposing wood chips to direct steam can be harmful to the chip fibers. The typically sudden increase in temperature of a chip due to exposure to steam can cause non-uniform treatment of the chip. For example, if the chip is not uniformly impregnated with cooking chemical, the increased temperature can cause non-uniform reaction of cooking chemical with the cellulose and non-cellulose components of the chip. This can be manifest in reduced pulp quality, for example, causing reduced paper strength, or in non-uniform delignification. The more uniform heating and treatment provided by the liquid-filled hydraulic digester is less prone to cause non-uniform treatment of the chip while submerged in a liquor.

The vapor-phase digester is also sensitive to variations in the relative chip and liquid levels. Since the principle means of heating the chips to cooking temperature in a vapor-phase digester is retention time in the steam atmosphere, any loss in this retention time means a loss in heating. Therefore, in a vapor phase digester, the chip level must always be maintained sufficiently above the liquid level to ensure proper heating. A loss of retention time in the steam atmosphere results in less heating of the chips which is manifest as increased uncooked chip particles, or "rejects" in the resulting pulp. For this reason, the operator of the vapor-phase digester must continuously monitor and regulate the level of liquid relative to the level of chips. This problem does not exist in a liquid-filled hydraulic digester which heats using liquid circulations.

Also, the chip pile above the liquid level in a vapor phase digester promotes a non-uniform pressure distribution and hence non-uniform vertical movement of chips in the digester, that is, it affects what is called "chip column movement". While submerged in liquid, the weight of the chips is somewhat counteracted by the buoyant force from the liquid. However, an unsubmerged chip pile exerts an unsupported load on the chips below depending upon the distribution of chips across the digester. Since the chips are typically introduced in the vicinity of the centerline of the digester, the conical chip pile exerts a greater downward load at the center of the chip column than at the walls of the digester. This additional load at the center in conjunction with friction from the vessel wall promotes movement of the chips down the center of the digester or what is known as "channeling". The consequent non-uniform movement of chips exposes the chips to non-uniform treatment. This can be manifest as increased rejects and weakened paper strength, as well as increased cooking chemical demand and poor operability of the digester. Again, a liquor-filled hydraulic digester is not as prone to such variations in column load and non-uniform movement.

However, the ability to introduce this additional downward force when necessary can be advantageous. When the downward movement of the chip pile is restricted, an unsubmerged chip pile can provide an additional downward load, for example, during upset conditions or when desired, that promotes the downward movement of the chip column. Thus, having the capability of varying the chip pile level in comparison to the liquid level, as desired, can provide the operator with additional flexibility for controlling the digester. This option is inherently unavailable in conventional hydraulic digesters. This capability is essentially prohibited in conventional vapor-phase digesters due to the critical retention time required in the vapor zone of the vapor-phase digester. Thus providing a digester having such a capability is novel in the art.

Furthermore, the gamma radiation emitters/detectors typically used to monitor and control the chip column level in a vapor-phase digester are also undesirable. A radiation emitting device of any kind is undesirable in a mill simply due to safety concerns and the need for certified technicians to service and maintain it. A digester which does not require such a device, such as a hydraulic digester, is preferred by mill management and maintenance personnel.

A hydraulic digester can also provide more efficient and uniform heating of the chips. A hydraulic digester having a counter-current heating circulation has been shown to more efficiently and more uniformly distribute heat and cooking chemical to the chip column. For example, a hydraulic digester employing Lo-Solids® cooking, as marketed by Ahlstrom Machinery and described in U.S. Pat. Nos. 5,489,363; 5,547,012; and 5,536,366, can have a flow of heated cooking and dilution liquor which when passed counter-currently to a down-ward flowing chip mass provides a more uniform heating of the chip column and more uniform distribution of liquor to the chip column. In particular, a digester that was once configured as a vapor-phase digester, can be re-configured to essentially function as a hydraulic digester with a counter-current heating circulation which replaces and improves upon the heating and chemical distribution provided by the original vapor-phase configuration. Heating chips by direct exposure to steam is not an efficient use of steam energy and not only damages the cellulose fibers, but it also introduces additional liquid to the system. This additional liquid, that is, steam condensate, only dilutes the desired liquid present in the chips. This moisture addition is inherent in directly exposing chips to steam. Direct exposure to steam introduces an additional 0.1 to 0.3 to the liquor-to-wood ratio in a steam phase digester compared to a hydraulic digester. This additional liquid provides no benefit to the cooking process, but disadvantageously does increase the evaporation requirements of the recovery system. In addition, this heating medium, the condensed steam, is lost to the rest of the pulping system. This is in contrast to indirect steam heating where the heating medium is essentially retained and recirculated in the steam circuit and can be used elsewhere as needed or reused to generate steam. The present invention avoids this inefficient use of energy and liquid.

Therefore, the digester of the present invention not only has several distinct advantages over the vapor-phase digester, but the present invention can be used to modify, or "retro-fit", an existing vapor-phase digester to operate more effectively in a mode similar to a hydraulic digester.

Existing vapor-phase digesters typically cannot be operated as hydraulic digesters due to the distinct differences in hardware and operation. Particularly, vapor-phase digester can not typically be operated as hydraulic digesters because vapor-phase digesters rely on the direct exposure of chips to steam for heating prior to being submerged in liquid. However, the present invention makes it possible to convert a vapor-phase digester to effectively function as a hydraulic digester, with all its operational and performance advantages, while providing the required advantageous mechanism for heating the chips.

There are some advantages of vapor-phase-type operation. For example, this gas-filled space above the chip and liquid level can reduce the fluctuations in liquor flows to the digester for pressure regulation. In a hydraulically-filled digester, pressure within the vessel is regulated by controlling the volume of liquor introduced, for example, wash filtrate introduced via a conventional pressure control valve. Under otherwise varying conditions, this can lead to excessive variation in the pressure-controlled flow. However the pressure within a vapor-phase digester is regulated by controlling the gas pressure in the gas-filled space. This is typically done by means of compressed gas via an inlet in the vicinity of the gas-filled space at the top of the digester. The introduction of gas at the top of the digester does not interfere with the liquid flows or column movement down below. Thus, having such a gas-filled space, containing steam or compressed gas, dampens the variations and can permit a more stable liquor flow to the digester.

Furthermore, it is also advantageous to have the capability to switch between one mode of heating and the other. For example, should the heating circulation screens become plugged during hydraulic heating, the operator of a digester designed according to the present invention has the option of heating the chips to cooking temperature by introducing steam to the top of the digester while the heating screens are inactive or being "wiped" by the chip column to remove the pluggage, or even backflushed.

In some prior art vapor-phase digesters chips can be treated counter-currently with cooking liquor. However, these digesters typically perform what is known as "prehydrolysis" prior to kraft cooking. Prehydrolysis is the acidic treatment of cellulose material in order to remove the hemicellulose components of the cellulose such that a relatively pure form of cellulose is produced. Such pulps are known as "viscose pulps" or "dissolving pulps" which are used as the basis for the manufacture of rayon fibers and cellulose films, such as cellophane. As shown for example in U.S. Pat. No. 3,380,883, the chips are treated by hydrolysis in a gas-phase of a continuous digester and are then immersed in alkaline liquid to terminate the acidic hydrolysis reaction and initiate the alkaline kraft pulping reaction. This alkaline treatment is performed counter-currently.

The viscose pulp producing process is distinct from the kraft process according to the present invention (which does not apply to the production of viscose pulp). Not only is it undesirable to remove the hemicellulose from kraft pulp (hemicellulose is significant to the strength properties, among other things, of kraft pulp), but the treatment shown in U.S. Pat. No. 3,380,883, for example, clearly addresses the particular requirements of prehydrolysis treatment and then kraft treatment. The counter-current flow of alkaline liquor is clearly meant to aid in separating the acidic liquor from the alkaline liquor.

The present invention also provides a digester and method of operating a digester, having a gas-filled space, that includes a pretreatment or impregnation zone at the top of the digester. In conventional vapor-phase digesters the chips that are introduced to the top of the digester are typically immediately exposed to high-temperature steam, that is, steam at a temperature greater than 130° C., typically greater than 150° C. At these temperatures, the cooking process is initiated and there is no allowance for further pretreatment or impregnation. Again, the reason for this is that the conventional vapor-phase digester essentially relies on this steam heating to raise the temperature of the chips to the desired cooking temperature, that is, 160°–170° C.

The present invention is not limited to commencing cooking at the top of the digester. By heating the chips to cooking temperature below the top of the digester, preferably by counter-current hydraulic heating, the digester section above the heating zone can be used for pretreatment, for example, at a cooler temperature. For example, the upper part of the digester can be used for co-current or counter-current impregnation of chips at a temperature less than cooking temperature. The temperature of this treatment zone may be between 80° and 150° C., typically between 90° and 140° C., and preferably between 100°–130° C. The temperature of this pretreatment can be independently controlled in relation to the temperature of the cooking zone by regulating the pressure and temperature of the steam introduced to the gas-filled space. This treatment can last for five minutes to two hours, but is preferably between ten and sixty minutes long.

The capability to control the temperature of the pretreatment according to the invention is particularly advantageous for treating the chips with yield or strength enhancing additives, such as anthraquinone, and its derivatives and equivalents, or polysulfide, and its derivatives and equivalents. For example, treatment with anthraquinone is typically limited to the temperature range of 90° to 110° C. and treatment with polysulfide is typically limited to the temperature range of 90° to 140° C. In conventional vapor-phase digesters, introducing such treatments at the top of the digester would be ineffective since the high steam temperatures would typically interfere with or simply decompose the additives.

The present invention is also applicable to multi-vessel digester systems, for example, a two-vessel system having an impregnation vessel located before the digester. The present invention introduces similar flexibility to the multi-vessel system as it does to the single-vessel system. For example, impregnation time in a two-vessel system can be extended by having a temperature lower than cooking temperature at the top of the second vessel. Present two-vessel vapor-phase systems are limited by introducing high temperature steam to the top of the second vessel.

According to one aspect of the present invention, a method of converting an existing cellulose pulp vapor phase digester having a top and a bottom, and inverted top separator at the top, a device for sensing the chip level above the liquid level in the digester, a first liquid level in the digester spaced a first distance from the inverted top separator and a trim circulation including a pump [but typically no heating device], to function essentially as a hydraulic digester, is provided. The method comprises the following steps: (a) Removing or deactivating the device for sensing the chip level. (b) Providing a second liquid level vertically spaced from the inverted top separator a second distance much less than the first distance; and (c) refurbishing or replacing the trim circulation so that a heating device is provided therein to heat liquid in the circulation. Typically, the liquid level sensor is a "dp cell" that does not have to be moved to vary the level. "dp cells" sense the head of a water column above a reference.

The method may also comprise the further step (d) of providing a screen assembly for withdrawing liquid from the digester between the circulation having a heating device and the inverted top separator. The method may also comprise the further steps, after steps (a)–(d), of (e) operating the converted digester so as to establish a liquid level in the digester above the level of chips but below the inverted top separator; (f) maintaining a gas-filled zone above the liquid level at a temperature of less than 160° C. and at a pressure between 50–200 psig; and (g) withdrawing cellulose pulp from adjacent the bottom of the digester. That is, the gas in the gas-filled zone typically is at super-atmospheric pressure, for example, between 50 to 200 psig, preferably, between 80 and 150 psi gauge. The temperature of the gas in this gas-filled zone is less than 160° C., typically less than 140° C., preferably, less than 130° C. The gas-filled zone may be air, nitrogen, or any other gas, or it may be steam, although compressed gas is preferred.

According to another aspect of the present invention, a method of operating a cellulose pulp digester having a top and a bottom, an inverted top separator at the top, and a discharge at the bottom, is provided. The method comprises the steps of: (a) Introducing a slurry of comminuted cellulosic fibrous material and cooking liquor (e.g. kraft cooking liquor) into the digester through the inverted top separator. (b) Establishing a liquid level in the digester below the inverted top separator. (c) Establishing a level of cellulosic fibrous material in the digester below the top separator (e.g. below the liquid level). (d) Establishing a gas-filled zone above the liquid level at a temperature of less than 160° C. and at a pressure between 50–200 psig; and (e) withdrawing cellulose (e.g. kraft) pulp from adjacent the bottom of the digester. Step (d) is practiced so as to maintain the temperature in the gas-filled zone at less than about 130° C., and the pressure at between 80–150 psig. There may also be the further step (f) of uniformly heating the cellulose material in the digester adjacent the top thereof by establishing a counter-current flow of heated cooking liquor which comes into contact with the cellulose material below the liquid level. Step (f) may be practiced by withdrawing liquid with a high level of dissolved organic material, establishing a circulation loop, and heating withdrawn liquid in the circulation loop, and introducing cooking liquor and a replacement liquid distinct from the cooking liquid, the replacement liquid having a low level of dissolved organic material.

According to another aspect of the present invention there is provided a continuous digester system for producing chemical cellulose pulp from cellulose chips. The system comprises the following components: A continuous digester vessel having a top and a bottom. A separator at the digester vessel top which introduces chips and liquid into the digester vessel and separates some of the liquid from the chips. Means for establishing a liquid level in the digester vessel below the separator. Means for establishing a chips level in the digester vessel below the separator (e.g. below the liquid level). Means for hydraulically heating the chips in the digester vessel to cooking temperature. Means for establishing a gas-filled zone in the digester above the liquid level; and means for withdrawing pulp from adjacent the bottom of the digester vessel.

The separator preferably comprises an inverted top separator, although any separating device which allows a liquid level with gas above it may be utilized. The means for establishing a gas-filled zone preferably comprises means for introducing compressed gas into the gas-filled zone, but any conventional structure for performing that function may be utilized. The means for hydraulically heating the chips in the digester preferably includes, adjacent the digester top, a recirculation loop including a recirculation screen, a pump, an indirect heater, and a conduit, liquid withdrawn through the screen by the pump being heated by the heater, and then returned to the digester by the conduit; however any other conventional structure for performing that function may be utilized. The means for hydraulically heating the chips typically further comprises, however, a withdrawal screen between the recirculation screen and the separator, for establishing a countercurrent flow of heated liquid to heat the chips.

As part of the means for establishing a level of chips the digester typically includes a means for detecting the level of chips, for example, one or more electro-mechanical devices, such as a conventional mechanical paddle having electronic strain gauges. However any suitable conventional structure for performing this ultimate function may be used as the chip level establishing means. Similarly, while the liquid level establishing means preferably comprises a dp cell, any suitable conventional structure for accomplishing that ultimate function may be utilized to establish liquid level.

According to yet another aspect of the present invention, a method is provided for operating a continuous cellulose digester vessel having a top and a bottom. The method comprises the following steps: (a) Introducing chips and liquid into the digester vessel and separating some of the liquid from the chips at a separation zone. (b) Establishing a liquid level in the digester vessel below the separation zone. (c) Establishing a chips level in the digester vessel below the separation zone (e.g. below liquid level). (d) Hydraulically heating the chips in the digester vessel to cooking temperature. (e) Establishing a gas-filled zone in the digester above the liquid level; and (f) withdrawing pulp from adjacent the bottom of the digester vessel. Step (e) may be practiced by adding compressed (e.g. inert) gas to the top of the digester vessel above the liquid level, the gas-filled zone preferably having a temperature of less than 140° C. and a pressure of between 80–200 psig. Step (d) is preferably practiced by removing liquid from the chips below the chips level, heating the removed liquid to raise its temperature and so that its temperature is at least about 130° C. (e.g. 160° to 180° C. or above), and recirculating the heated liquid back into the digester at a reintroduction zone below the chips level.

These and other aspects of this invention will become clear from the following detailed description of the drawings, and the appended claims.

DETAILED DESCRIPTION OF THE DRAWINGS

Figure 1:
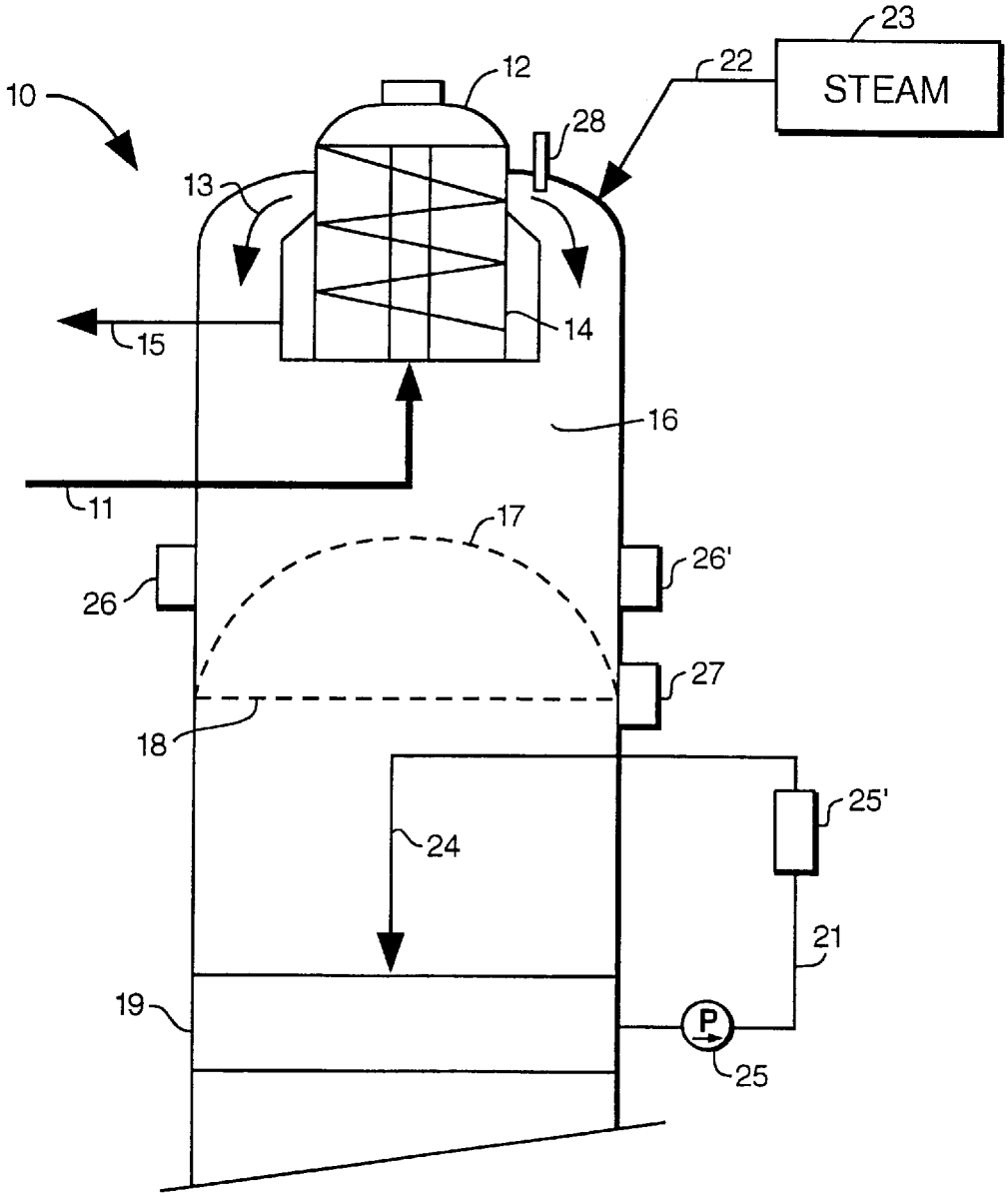
Fig. 1 (PRIOR ART)
FIG. 1 is a schematic side view, partly in cross section and partly in elevation, of a typical inlet and upper section of a conventional vapor-phase digester.
Figure 2:
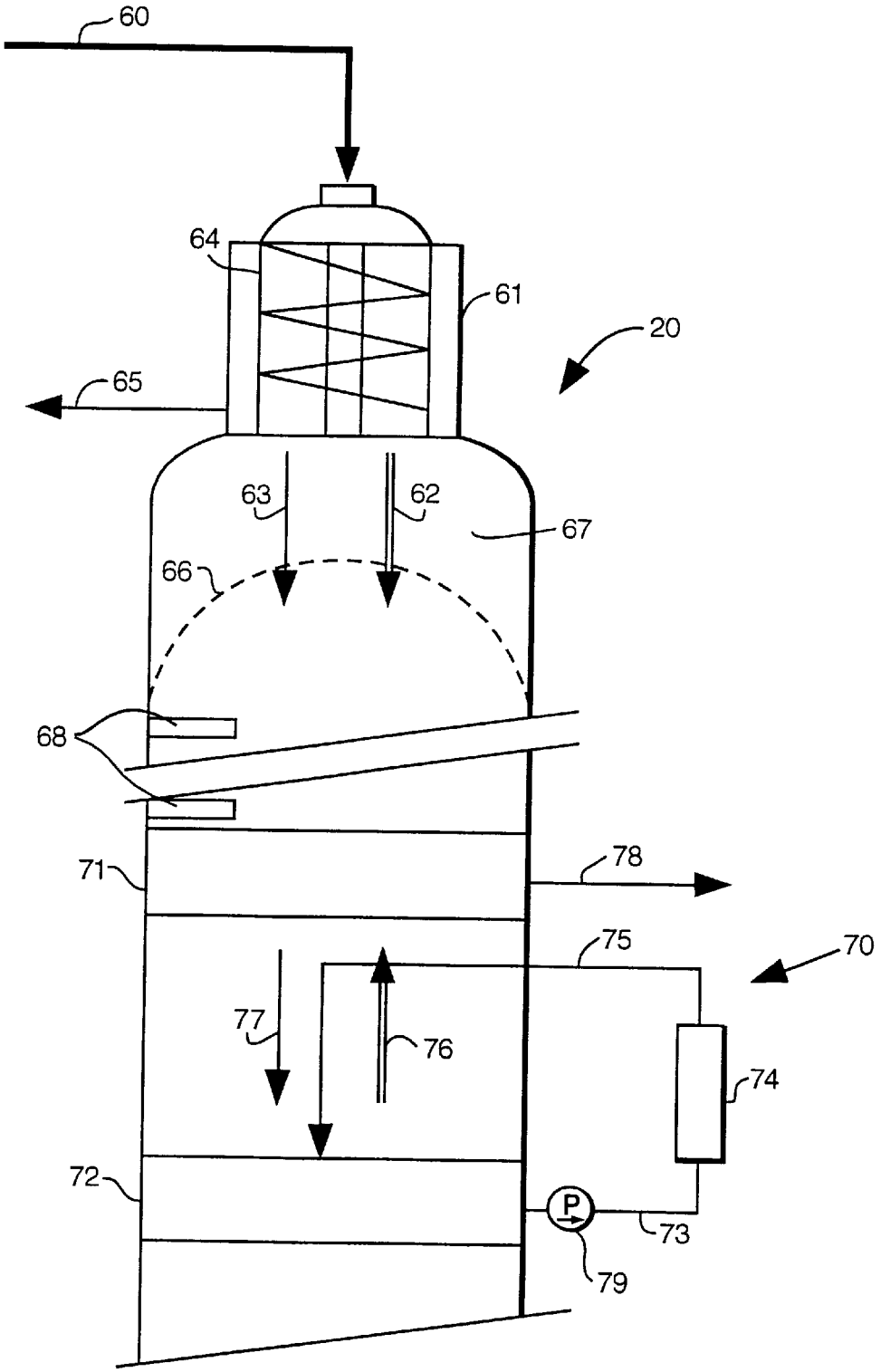
Fig.2 (PRIOR ART)
FIG. 2 is a view like that of FIG. 1 of a typical inlet and upper section of a conventional hydraulic digester.

FIGS. 1 and 2 illustrate the top sections of two conventional continuous digesters. The top of a vapor-phase digester, 10, is shown in FIG. 1; a hydraulic digester, 20, is shown in FIG. 2. These digesters may be the only digesting vessels in the pulping system or they may be one of two vessels, for example, the system may also include a second vessel, known in the art as an impregnation vessel. These digesters typically receive a slurry of comminuted cellulosic fibrous material, typically wood chips, in cooking liquor, such as kraft white liquor. The slurry is typically first treated in a feed system, for example, a Lo-Level™ feed system as sold by Ahlstrom Machinery of Glens Falls, N.Y.

The vapor-phase digester of FIG. 1 is typically fed a slurry of chips and liquor in conduit 11. The slurry is introduced to the digester using a conventional vertically-oriented screw conveyor 12 known in the art as an "inverted top separator". The slurry is transported upwardly in the separator 12 and chips and liquor are discharged from the top of the separator 12 as shown by arrows 13. As the slurry is transported upwardly, excess liquor is removed from the slurry using a cylindrical screen 14 and returned to the feed system by way of conduit 15. The chips and liquor 13 discharged from separator 12 fall through a gas-filled zone 16 onto a chip pile 17. In order to continue the steam heating of the chips, the level of the chip pile 17 is maintained above the level of the cooking liquor 18, as seen in FIG. 1. After steam heating, the chips are immersed in cooking liquor, passing below the liquid level shown at 18 in FIG. 1, and the cooking processes continues.

In order to improve the distribution of heat across the chip column and chip pile 17, a vapor-phase digester 10 typically also include a liquor removal screen 19 and circulation 21, for drawing liquor radially outward, removing it and returning it via a centrally-located pipe 24 to the chip column. Circulation 21 typically includes a pump 25 and may include a liquor heater 25'. The liquor removal screen 19 and the associated circulation 21 (including pump 25 and pipe 24) are referred to in the art as the "trim circulation". Below the trim circulation screen 19, with a more uniform distribution of heat and chemical, the cooking process continues.

In vapor-phase digester 10 the level of the chip pile 17 is typically monitored by a gamma radiation source and detector, shown schematically at 26 and 26', respectively, in FIG. 1, located opposite each other in the vicinity of chip pile 17. The source/detector 26, 26', senses the presence or absence of chips in pile 17 and the level of chips can be controlled by either varying the flow of slurry into the vessel 10 or varying the flow of pulp out of the vessel 10. The pulp is discharged from the bottom of the vessel 10 using entirely conventional discharge apparatus.

In addition to the chip level, in a vapor-phase digester 10 the liquor level must also be monitored and controlled. The liquor level 18 is typically monitored using a conventional liquor level detector, shown schematically at 27 in FIG. 1, for example, a "dp" cell or the like, which sensed the head of a liquid column above a reference.

The pressure and temperature of the vapor-filled zone 16 must also be monitored in a vapor-phase digester 10. The pressure in zone 16 is typically maintained using an air, compressor which feeds pressurized air (or other gas inert to the chemical processes in the digester 10, such as almost pure nitrogen gas) to the top of the digester 10 in response to loss of a reference pressure. Excess pressure, for example, pressure introduced by the gases introduced with the incoming chip slurry, is typically vented using a conventional pressure relief device, shown schematically at 28 in FIG. 1. The temperature in zone 16 is monitored and controlled by adding pressurized steam via conduit 22 from steam source 23. Similar to the vapor phase digester 10 of FIG. 1, the conventional hydraulic digester 20 in FIG. 2 receives a slurry of chips and liquor from a feed system via conduit 60. The slurry is introduced to the digester 20 by a conventional "top separator" 61, which is a downwardly directed screw-conveyor. The liquor introduced by separator 61 is shown as double arrow 62; the chips by single arrow 63. As the slurry is transported downwardly by conveyor 61, excess liquor is removed from the slurry through cylindrical screen 64 and returned to the feed system (e.g. high pressure feeder) or impregnation vessel by conduit 65.

The chips introduced by the separator 63 produce a level of chips 66. Since digester 20 is hydraulically full, the zone 67 above chip level 66 is filled with liquid, so that no gaseous zone typically exists. The level of chips in the liquid-filled vessel 20 is typically monitored using one or more conventional mechanical paddles 68 (e.g. sold by Ahlstrom Machinery Inc. of Glens Falls, N.Y. under the designation "K-1000") located along the inner surface of the vessel with associated electronic strain gauges. The presence or absence of chips is detected by the agitation of the paddles 68 and the chip level is computed, in percent, based upon a mathematical algorithm. No gamma radiation equipment (such as 26, 26' in FIG. 1) is needed. As in the vapor-phase digester, the level of chips in hydraulic digester 20 can be controlled by either varying the inflow of slurry or the outflow of cooked chips.

In contrast to digester 10 in FIG. 1, the chips on the top of pile 66 are typically not heated to full cooking temperature, but must be heated before cooking commences. This is typically done utilizing one or more heated cooking circulation loops 70. Heating may be performed co-currently or counter-currently; the circulation loop 70 shown in FIG. 2 heats the chips counter-currently. The slurry first pass a liquor-removal (withdrawal) screen 71 which removes liquor from the slurry through conduit 78. Liquor removed via conduit 78 may be forwarded to chemical recovery or may be used for pretreating chips before digester 20. This liquor removal draws free liquor, shown by double arrow 76, counter-currently past the downwardly flowing chips, shown by single arrow 77. The heated liquor 76 is obtained from circulation 70. The liquor is first removed from the slurry via screen 72 via conduit 73 and a pump 79, heated in indirect steam heater 74 (e.g. to a temperature of 135° to 170°), and returned to the vicinity of screen 72 by centrally located return conduit 75. Cooking liquor, for example, kraft white liquor, is typically added to this circulation. If Lo-Solids® cooking, as described in U.S. Pat. Nos. 5,489,363; 5,547,012; and 5,536,366 and marketed by Ahlstrom Machinery, is performed in vessel 20, some of the liquor removed from via conduit 73 may be forwarded to the chemical recovery system and replaced with a low dissolved organic material liquid, such as a combination of cooking liquor and dilution liquid or water.

After heating to cooking temperature in circulation 70, the slurry can be cooked and otherwise further treated below screen 72.

Figure 3:
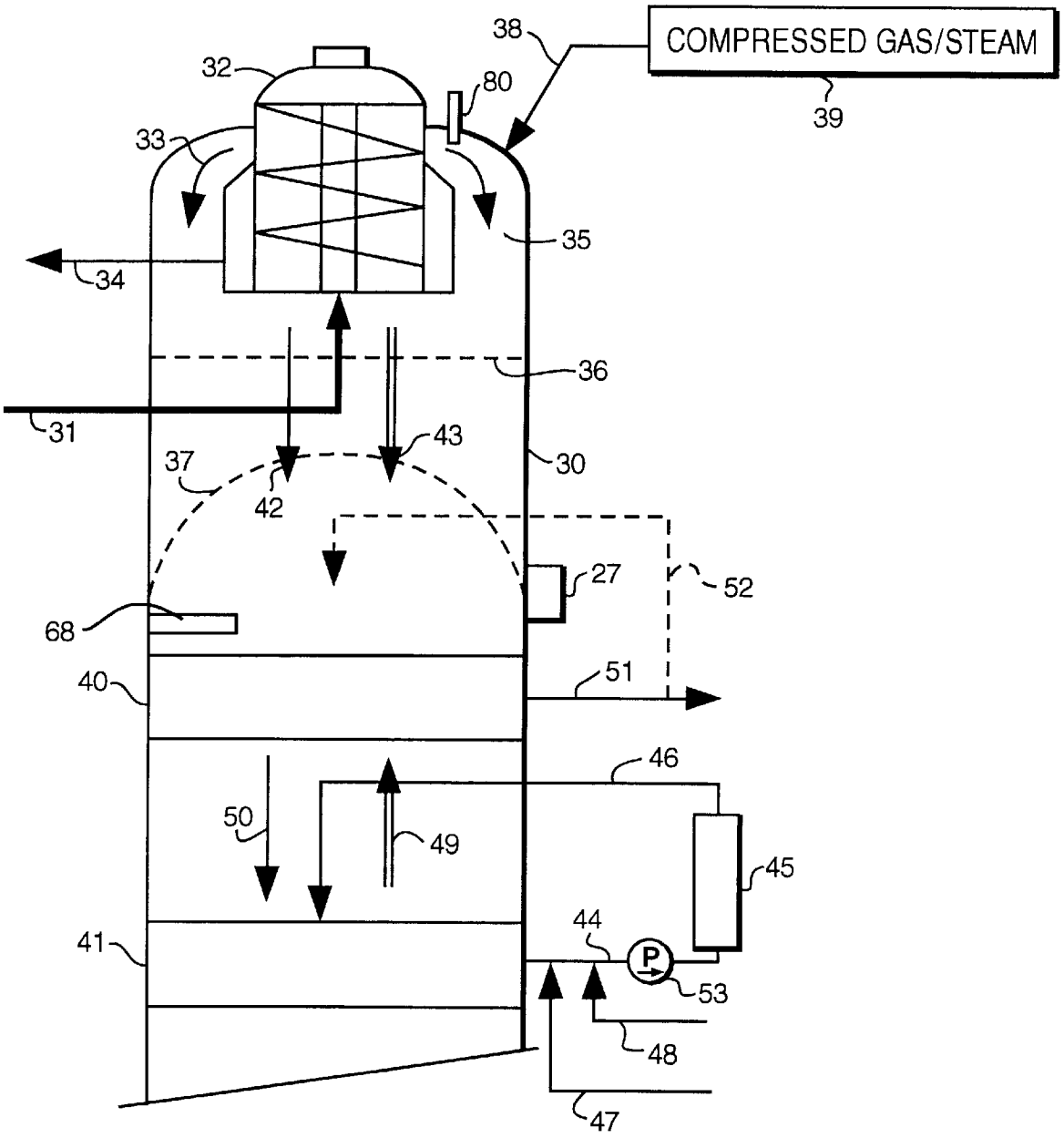
FIG. 3 is a view like that of FIGS. 1 and 2 of a typical inlet and upper section of a digester according to the present invention, for practicing methods according to the present invention.

FIG. 3 illustrates a digester 30 for practicing one preferred embodiment of the invention. The digester 30 can be constructed by modifying a digester 10, by removing or deactivating sensor elements 26, 26', adding paddles 68, and adding a heater 74 to and perhaps repositioning the "trim circulation" 21. Usually the dp cell 27 need not be relocated or replaced. Alternatively the digester 30 may be constructed as new.

Similar to use of the system of FIG. 1, a slurry of chips and liquor are introduced to the top of digester 30 via conduit 31 and conventional inverted top separator 32, as sold by Ahlstrom Machinery. The slurry is typically introduced to digester 30 at a temperature of between 90° and 130° C., depending upon the treatment of the chips in the feed system prior to the digester 30. For example, if the feed system consists of a Lo-Level™ Feed system, as marketed by Ahlskom Machinery, Glens Falls, N.Y., and described in U.S. Pat. No. 5,476,572 and in U.S. Pat. No. 5,625,598 the slurry enters the digesters at between about 95°–100° C. When the chips are fed by a conventional feed system, for example, one having a pressurized, horizontal steaming vessel, the slurry enters the digester at between 115°–120° C. As is conventional, the top separator 32 removes excess liquid from the slurry as it transfers it upwardly and discharges chips and liquid as shown by arrows 33. The removed liquor is returned via conduit 34 to the upstream stages, for example to a High-pressure Feeder or Impregnation vessel as sold by Ahlstrom Machinery.

The chips 33 are exposed to a gaseous atmosphere 35 before entering the liquor at level 36 and falling onto the chip pile 37. The gaseous atmosphere 35 above the liquid level 36 typically comprises or consists of air or gases that are introduced to the digester 30 with the slurry of chips and liquor. If required or desired, this air may be supplemented by other gases such as steam, nitrogen, or any other suitable gas which can be used for treatment or to maintain the desired pressure. In sulfite pulping systems, the gas space 35 is typically filled with sulfur dioxide [$SO_2$] gas. This atmosphere 35 is maintained at a temperature less than 160° C., typically less than 140° C., and preferably less than 130 (and even less than 120)° C., and at a pressure ranging from 50 to 200 psig, preferably, between 80–200 psig, e.g. between 80 and 150 psi gauge. In order to maintain the pressure in space 35, as is typical of the prior art, pressurized gas may be introduced via conduit 38 from source 39. Also, as known in the art, excess pressure may typically be released using a conventional pressure relief device 80. At the top of the digester 30 the chips, illustrated by arrow 42, flow co-currently with the liquor, shown by double arrow 43.

The liquid level 36 is typically monitored by a conventional level indicator, such as a "dp cell" 27, though other devices may be used. The liquid level can be varied by regulating the flow of liquid into or out of digester 30, for example, by regulating the flow out of conduit 51, or any other suitable conduit that removes or introduces liquid to the digester 30. The chip level 37 is also independently monitored by means of one or more conventional mechanical paddles and strain-gage devices 68 mounted in the wall of digester 30 in the vicinity of the chip level 37. As is conventional, the level of the chips 37 can be regulated by increasing or decreasing the flow of chips into the digester 30 or increasing or decreasing the flow of pulp out of the digester 30.

Since the incoming chips are preferably not exposed to steam in the gas atmosphere 35, the chips are preferably heated to cooking temperature hydraulically, e.g. using one or more heated liquor circulations. One preferred method of treating the chips is by using the screen assemblies 40 and 41. Liquor is removed via screen assembly 41 via conduit 44, typically with the aid of a conventional pump 53. The removed liquor is heated with steam via indirect heat exchanger 45 (e.g. to at least about 130° C.) before it is returned via conduit 46 to the vicinity of screen 41. Typically, cooking chemical, for example kraft white or black liquor, is added to the 44 circulation via conduit 47. Preferably, Lo-Solids® cooking is also performed in the digester 30, as described in U.S. Pat. Nos. 5,489,363; 5,547,012; and 5,536,366 and marketed by Ahlstrom Machinery. If this is so, low dissolved organic material liquid, such as dilution liquor, for example, washer filtrate, bleach plant filtrate, or weak black liquor, may be added to conduit 44 via conduit 48.

The heated liquor re-introduced to the digester 30 via conduit 46 preferably passes counter-currently, as shown by double arrow 49, to the downflowing chips, as shown by arrow 50. Liquor 49 is drawn counter-currently as a result of the liquor removed via screen 40 into conduit 51. The liquor 49 typically heats the downflowing chips 50 to a cooking temperature of between 140°–180° C. Though the flow of liquor shown in FIG. 3 is counter-current, a heated co-current liquor flow may be used instead of the counter-current flow or in conjunction with a counter-current flow. The liquor in conduit 51 may be passed to the chemical recovery system or may be used to pretreat chips prior to or during treatment in digester 30. Optionally a return recirculation 52 may also be provided.

After passing screen 41, the heated chip slurry is typically retained at temperature to continue the pulping process or may be treated further in subsequent zones of the digester 30 prior to being discharged.

Due to the low temperature (preferably 130° C. or less) of the atmosphere 35, the pulp may be treated with yield and/or strength enhancing additives such as anthraquinone and its derivatives, and/or polysulfide and its derivatives and equivalents, prior to introducing the pulp into vessel 30 without destruction of the additives. The temperature in atmosphere 35 should be maintained between 90°–110° C. if treatment (or continued treatment) with anthraquinone or its derivatives takes place therein, and between 90°–140° C. if treatment (or continued treatment) with polysulfide and its derivatives or equivalents takes place therein. Treatment in atmosphere 35 may be between five minutes and two hours, preferably about ten to sixty minutes, and the desired conditions are maintained by regulating the temperature and pressure of the steam introduced at 38 in FIG. 3.

The present invention as described with respect to FIG. 3 provides a method for treating comminuted cellulosic fibrous material to produce wood pulp, or for modifying an existing vapor-phase digester to produce kraft pulp, which promotes more uniform heating and treatment of the chips, is less susceptible to changes in chip level variations, is less prone to channeling, obviates the need for a source of radiation to detect the chip level, provides a digester that is easier to operate. While the invention has been herein shown and described in what is presently considered to be the most practical form of the invention, it is to be understood that many modifications may be made thereof within the scope of the invention, which scope is to be accorded the broadest interpretation of the appended claims so as to encompass all equivalent structures and methods.

What is claimed is:

1. A method of operating a cellulose pulp digester having a top and a bottom, an inverted top separator at the top, and a discharge at the bottom, comprising the steps of:

(a) introducing a slurry of comminuted cellulosic fibrous material and kraft cooking liquor into the digester through the inverted top separator;

(b) establishing a liquid level in the digester below the inverted top separator and effecting a rise in temperature of the material to substantially kraft cooking temperature below the liquid level;

(c) establishing a level of cellulosic fibrous material in the digester below the top separator;

(d) establishing a gas-filled zone above the liquid level at a temperature of less than 140° C. and at a pressure between 50–200 psig; and (e) withdrawing kraft pulp from adjacent the bottom of the digester.

2. A method as recited in claim 1 wherein step (d) is practiced so as to maintain the temperature in the gas-filled zone at less than about 120° C., and the pressure at between 100–150 psig.

3. A method as recited in claim 2 wherein step (d) is practiced so as to be (d1) 110° C. or less, or (d2) 140° or less; and comprising the further step of treating the pulp with anthraquinone or its derivatives if sub-step (d1) is practiced, or polysulfide or its derivatives or equivalents if either sub-steps (d1) or (d2) are practiced, prior to the pulp entering the gas filled zone, and comprising the further step of maintaining the pulp in the gas filled zone between about 10–60 minutes.

4. A method as recited in claim 2 wherein step (b) is further practiced by uniformly heating the cellulose material in the digester adjacent the top thereof by (f) establishing a countercurrent flow of heated cooking liquor which comes into contact with the cellulose material below the liquid level.

5. A method as recited in claim 4 wherein step (f) is practiced by withdrawing liquid with a high level of dissolved organic material, establishing a circulation loop, and heating withdrawn liquid in the circulation loop, and introducing cooking liquor and a replacement liquid distinct from the cooking liquid, the replacement liquid having a low level of dissolved organic material.

6. A method as recited in claim 1 wherein step (d) is practiced so as to be (d1) 110° C. or less, or (d2) 140° or less; and comprising the further step of treating the pulp with anthraquinone or its derivatives if sub-step (d1) is practiced, or polysulfide or its derivatives or equivalents if either sub-steps (d1) or (d2) are practiced, prior to the pulp entering the gas filled zone, and comprising the further step of maintaining the pulp in the gas filled zone between about 10–60 minutes.

7. A method as recited in claim 6 wherein step (b) is further practiced by uniformly heating the cellulose material in the digester adjacent the top thereof by (f) establishing a countercurrent flow of heated cooking liquor which comes into contact with the cellulose material below the liquid level.

8. A method as recited in claim 7 wherein step (f) is practiced by withdrawing liquid with a high level of dissolved organic material, establishing a circulation loop, and heating withdrawn liquid in the circulation loop, and introducing cooking liquor and a replacement liquid distinct from the cooking liquid, the replacement liquid having a low level of dissolved organic material.

9. A method as recited in claim 1 wherein step (b) is further practiced by uniformly heating the cellulose material in the digester adjacent the top thereof by (f) establishing a countercurrent flow of heated cooking liquor which comes into contact with the cellulose material below the liquid level.

10. A method as recited in claim 9 wherein step (f) is practiced by withdrawing liquid with a high level of dissolved organic material, establishing a circulation loop, and heating withdrawn liquid in the circulation loop, and introducing cooking liquor and a replacement liquid distinct from the cooking liquid, the replacement liquid having a low level of dissolved organic material.

11. The method as recited in claim 1 wherein step (a) is practiced with the slurry of material at a temperature of between 90°–130° C.

12. The method as recited in claim 1 wherein step (a) is practiced with the slurry of material at a temperature of between about 95°–100° C.

13. A method of operating a continuous cellulose digester vessel having a top and a bottom;

(a) introducing chips and liquid into the digester vessel and separating some of the liquid from the chips at a separation zone;

(b) establishing a liquid level in the digester vessel below the separation zone;

(c) establishing a chips level in the digester vessel below the separation zone;

(d) hydraulically heating the chips in the digester vessel to cooking temperature;

(e) establishing a gas-filled zone in the digester above the liquid level; and (f) withdrawing pulp from adjacent the bottom of the digester vessel.

14. A method as recited in claim 13 wherein step (e) is practiced by adding compressed gas to the top of the digester vessel above the liquid level, the gas-filled zone having a temperature of less than 140° C. and a pressure of between 80–200 psig.

15. A method as recited in claim 14 wherein step (d) is practiced by removing liquid from the chips below the chips level, heating the removed liquid to raise its temperature and so that its temperature is at least about 130° C., and recirculating the heated liquid back into the digester at a reintroduction zone below the chips level.

16. A method as recited in claim 15 wherein step (d) is further practiced by withdrawing liquid from the digester between the reintroduction zone and the chips level to establish a countercurrent flow of heated liquid.

17. A method as recited in claim 13 wherein step (d) is practiced by removing liquid from the chips below the chips level, heating the removed liquid to raise its temperature and so that its temperature is at least about 130° C., and recirculating the heated liquid back into the digester at a reintroduction zone below the chips level.

18. A method as recited in claim 17 wherein step (d) is further practiced by withdrawing liquid from the digester between the reintroduction zone and the chips level to establish a countercurrent flow of heated liquid.

19. The method as recited in claim 13 wherein step (a) is practiced with the slurry of material at a temperature of between 90°–130° C.

20. The method as recited in claim 13 wherein step (a) is practiced with the slurry of material at a temperature of between about 95°–100° C.

* * * * *